US005688458A

United States Patent [19]

Koschinek et al.

[11] Patent Number: 5,688,458

[45] Date of Patent: Nov. 18, 1997

[54] METHOD AND DEVICE TO MANUFACTURE SYNTHETIC ENDLESS FILAMENTS

[75] Inventors: Gunter Koschinek, Dietzenbach; Dietmar Wandel, Hanau, both of Germany

[73] Assignees: Maschinenfabrik Rieter AG, Winterthur, Switzerland; Zimmer AG, Frankfurt am Main, Germany

[21] Appl. No.: 617,626

[22] Filed: Mar. 19, 1996

Related U.S. Application Data

[63] Continuation of Ser. No. 358,318, Dec. 19, 1994, abandoned, which is a continuation of Ser. No. 146,192, filed as PCT/CH93/00061, Mar. 9, 1993, abandoned.

[30] Foreign Application Priority Data

Mar. 18, 1992 [DE] Germany ..... 42 08 568.3

[51] Int. Cl.[6] ..... B29C 35/16; D01D 5/12

[52] U.S. Cl. ..... 264/211.12; 264/211.14; 264/237; 425/72.2; 425/378.2; 425/382.2

[58] Field of Search ..... 264/211.12, 211.14, 264/237; 425/72.2, 378.2, 382.2

[56] References Cited

U.S. PATENT DOCUMENTS

| | | | |
|---|---|---|---|
| 3,492,691 | 2/1970 | Carr | 264/211.14 X |
| 3,611,485 | 10/1971 | Leybourne, III et al. | 425/445 |
| 4,496,505 | 1/1985 | Tanji et al. | 264/101 |
| 4,529,368 | 7/1985 | Makansi | 425/72.2 |
| 4,712,988 | 12/1987 | Broaddus et al. | 425/72.2 |
| 5,234,327 | 8/1993 | Martin | 425/72.2 |
| 5,340,517 | 8/1994 | Koschinek et al. | 264/211.12 X |
| 5,360,589 | 11/1994 | Wandel et al. | 264/211.12 |

FOREIGN PATENT DOCUMENTS

| | | | |
|---|---|---|---|
| 530 652 | 3/1993 | European Pat. Off. . | |
| 774 814 | 5/1957 | United Kingdom . | |
| 1 169 604 | 11/1969 | United Kingdom . | |
| 1 220 424 | 1/1971 | United Kingdom | 264/237 |
| 2 125 629 | 3/1984 | United Kingdom . | |

OTHER PUBLICATIONS

Abstract of Japan 56–96,908 (Published Aug. 5, 1981).

*Primary Examiner*—Leo B. Tentoni

*Attorney, Agent, or Firm*—Burns, Doane, Swecker & Mathis, LLP

[57] ABSTRACT

Filaments emerging from the nozzle plate of a spinneret are cooled by being passed through a cooling channel. The motion of the filaments through the cooling channel serves to suck-in air through an air inlet arrangement of the cooling channel. The air inlet arrangement includes an upper air inlet which sucks-in air at the underside of the nozzle plate, so that the filaments are contacted by the cooling air immediately upon emerging from the nozzle plate. Contact of the cooling air with the filaments (which are drawn off at a speed of at least 2400 m/min) takes place throughout the length of the cooling channel.

14 Claims, 7 Drawing Sheets

METHOD AND DEVICE TO MANUFACTURE SYNTHETIC ENDLESS FILAMENTS

RELATED INVENTION

This is a continuation of application Ser. No. 08/358,318, filed Dec. 19, 1994, now abandoned, and which is a continuation of U.S. Ser. No. 08/146,192, filed as PCT/CH93/00061, Mar. 9, 1993, now abandoned.

BACKGROUND OF THE INVENTION

The invention relates to a method and a device for spinning and cooling of synthetic, multifil, spinning oriented endless filaments by means of a spinning device with spinning heads containing nozzle plates and cooling channels with air-permeable walls, through which, solely by way of a frictional intake of the air through the filaments an air current is drawn into the inside of the cooling channels.

Multifil endless filaments of synthetic polymer are produced from the melt mass at the spinning temperature by means of a spinning device (spinneret). The melt mass is pressed through the holes of a nozzle plate, the extruded melt strands are then cooled off and gathered to make a filament bundle, which is provided with a spinning compound and drawn off by means of a drawing off device and finally wound.

The cooling process is of special importance. The evenness of the cooling off process directly affects the physical characteristics of the filaments, such as evenness of the filament thickness (Uster) or of the staining. Irregularities are caused through non laminar or turbulent currents of the cooling air. Until the melt strands, being extruded at high spinning temperature, are cooled off to below the point of solidification they may not collide or be touched with thread guides since they would adhere otherwise.

Systems with cooling air provided from an air conditioning unit, transfer of the air through channels to cooling channels and injection by way of the pre-pressure, produced by blowers, into the range of the melt strands below the nozzle plate have proved to be reliable. Expensive devices for air distribution, regulating and homogenizing devices, however, are required in order to supply the turbulent cooling air in a directed and laminar manner.

Examples for respective embodiments are such with cross flow, i.e. mainly perpendicular penetration of the air flow through the filaments and direct discharge of the melt heat leewards (U.S. Pat. No. 4,529,368), as well as embodiments with radially applied air flow, i.e. directing the air from outside into the filament bundle and discharge of the heat mainly in the running direction of the filaments (U.S. Pat. No. 4,712,988 and German Document DE-A 34 06 347).

Another method to produce a cooling air stream is to lead the filaments through vacuum systems in which, because of the vacuum, the cooling air current is produced (U.S. Pat. No. 4,496,505 and WO 90-02222A).

Directing an air stream against the melt strand either pressurized or at subpressure, is in any case, today's state of the art for the necessary cooling of the melt strand in order to gather them to a filament bundle and to process them further.

Furthermore the German Document DE-A 19 14 556 describes a device for spinning and cooling of synthetic endless filaments, where the required cooling air current is produced within a tube provided with a multitude of perforations, through which the bundle of melt strand extruded from a nozzle plate is directed. This is an arrangement according to FIGS. 5 and 6 of that document. The tube is particularly designed in such a way that within the range following down from the spinning head over a length of at least 300 mm no perforation is provided, whereby an intake of outside air into the range behind the tube is explicitly prevented. The melt strand thus, immediately after leaving the spinning heads are not to be subjected to cooling. The consequence is that a correspondingly longer cooling distance is required, to which the above mentioned DE-A 3406347, page 5, paragraph 1, refers explicitly.

SUMMARY OF THE INVENTION

The object of the invention is to provide a method and a device for spinning and cooling of synthetic endless filaments, which can be achieved with a minimum of equipment and controlling devices and which in particular is suitable for high drawing-off speeds. The task, as object of the invention, is solved on the basis of the method mentioned at the beginning, in that at drawing-off speeds of at least 2400 m/min the air current is immediately directed towards the lower side of the spinning head and further with no interruption over the length of the cooling channel.

In contrary to the aforementioned German Document DE-A 19 14 556 the cooling air from the surrounding air is lead directly onto the melt strands at the lower side of the spinning heads, and this by the fact that the air is drawn in through the friction between the air and and the filaments being lead through the respective air channel, which to certain extent, can be compared with an injection effect. This injection effect extends over the whole length of the cooling channel and in particular also over the range immediately at the lower side of the spinning heads, so that the melt strand to be cooled are subjected to cooling immediately after leaving the spinning head. Whereby the cooling channel provides a channelling effect for the air entering along the direction of the filaments, which thus produce an air current, which evenly encloses the filaments and thus providing a continuous even cooling.

Surprisingly, it has arisen, that, by way of the above mentioned injection effect which produces cooling and which in particular concerns the range immediately at the lower side of the spinning heads, that as a feature of the invention, it results in particular at high drawing-off speeds in filaments, which on one hand, because of their high drawing-off speed which have a spinning orientation, which, when otherwise using the device according to DE-A 1914556 because of the preferred drawing-off speed of 1000 m/min indicated in this document, cannot develop, and on the other hand have an evenness in filaments, which, when using the device according to DE-A 1914556 in connection with the drawing-off speed of more than 2400 m/min and because of the specified intentional exclusion of the range below the spinning head as mentioned in this document, cannot be achieved by the cooling. According to the feature of the invention, the even cooling results through the perforated channels in the range immediately below the spinning heads, additionally leads to the feature, that the thus manufactured single filaments are of a high evenness over their length from one to the other single filament.

Furthermore the main advantage for the practical application, compared to the conventional cooling systems with streams of pressurized air or of air at subpressure which need considerable technical resources, in particular blowers, is that respective technical resources are not necessary, and thus the method according to the invention provides in a practical and advantageous way the production of filaments, which is particularly economical. Separate and energy consuming air conditioning installations to provide the cooling air, inlet channels and installation for homogenization to obtain laminarization of the turbulent air are not necessary.

Since, by application of the method according to the invention, a specific evenness of the air stream is obtained, the average gap between the single filaments at the outlet of the cooling channel can be less than 6 mm.

The device for the application of the method according to the invention is of such feature, that the wall of the cooling channels over the whole length is provided with perforations for air inlet, so that, also in case of a connection of the cooling channels directly to the lower side of the spinning heads, air can be drawn into the cooling channel right in this area. Furthermore it is also possible to arrange the cooling channel with a space from the lower side of the spinning head, in order to provide this particularly critical point with a large cross section for the air inlet. Whereby the gap formed by the space between cooling channel and the spinning head is suitably kept that large, that through the gap only air is taken into the cooling channel and that no counterflow develops in the gap, thus avoiding development of turbulences within the cooling channel.

Preferably the device is made in such a way, that the inlet of cooling air within the range immediately below the spinning head can be regulated. In case that the cooling channel is directly connected to the lower side of the spinning head, this is done in such a way that the perforations, with regard to their cross section, can be adjusted. In case of a space between the cooling channel and the lower side of the spinning head, this gap can be made adjustable with respect to its width.

The cooling channel can be made as a metallic screen, whereby in this case, over its whole surface relatively large inlets are provided in close relation.

It is also possible to make the cooling channel as perforated channel, which, over its whole surface is provided with perforations. Preferably the holes have a diameter of between 1 to 5 mm and in their sum extend over a surface which does not exceed 50% of the total surface.

The shape of the cooling channels is preferably similar to that of the nozzle plates, which can be round, oval or rectangular. Accordingly, the cooling channels have a circular, oval or rectangular cross section, which, preferably is 10 to 60 mm larger than the section encircling the area of the holes of the nozzle plate. The cross section of the cooling channel is preferably constant over its complete length. In an alternative embodiment of the range with constant cross section, near the outlet zone, a short range follows with a converging cross section towards the lower end, whereby the lower opening, for the outlet of the filament bundle, is provided with a minimum diameter i.e. a minimum measure of more than 10 mm.

The cooling channel may preferably be of cylindrical shape with a second cylinder arranged concentrically at a distance, whereby both cylinders are provided with perforation. The outer cylinder in this case has the certain effect of steadying the air current, so that the air taken in by the cooling channel (inner cylinder) thus comes from a zone of a steady air flow and accordingly flows evenly within the inside of the cooling channel.

To enable an adjustment of the cross section of the perforation in the cooling channel in a simple manner, the cooling channel can be made cylindrical and a further cylinder can be slide over it, whereby both cylinders are provided with perforation and by counter turning the cylinder's perforations can be adjusted to achieve varying coverage of the holes. With this a respective desired cross section of the air inlet can be set.

The method according to the invention is preferably suitable to manufacture single filament titers of 0.3 to 3.0 dtex at drawing-off speeds of 2400 to 7000 m/min, in particular preferable 0.3 to 1.5 dtex at 2400 to 5000 m/min, however taking into consideration the ratio between drawing-off speed and spinning titer listed in the following.

Specially advantageous conditions exist if filament titers are manufactured for certain speed ranges. It was experienced that the ratio of drawing-off speeds and the spinning titer of the single filament, calculated in the dimensions m/min and dtex, with at least 1800 is of advantage. Ratios higher than 8000 lead to filament breakage and ratios higher than 10,000 increasingly lead to filament breaks. Preferably the ratio is chosen to be less than 6000.

As drawing-off speed (spinning speed respectively) the speed of the first driven galette after the point of convergence is defined. With filament drawing-off without galettes the speed of the winding device applies. The single filament titer, respectively the spinning titer, at the drawing-off device, is calculated in known manner in relation to the defined drawing-off speed.

BRIEF DESCRIPTION OF THE DRAWINGS

The invention will be described hereafter in relation to the drawings, wherein.

DETAILED DESCRIPTION OF THE PREFERRED EMBODIMENTS

Figure 1:
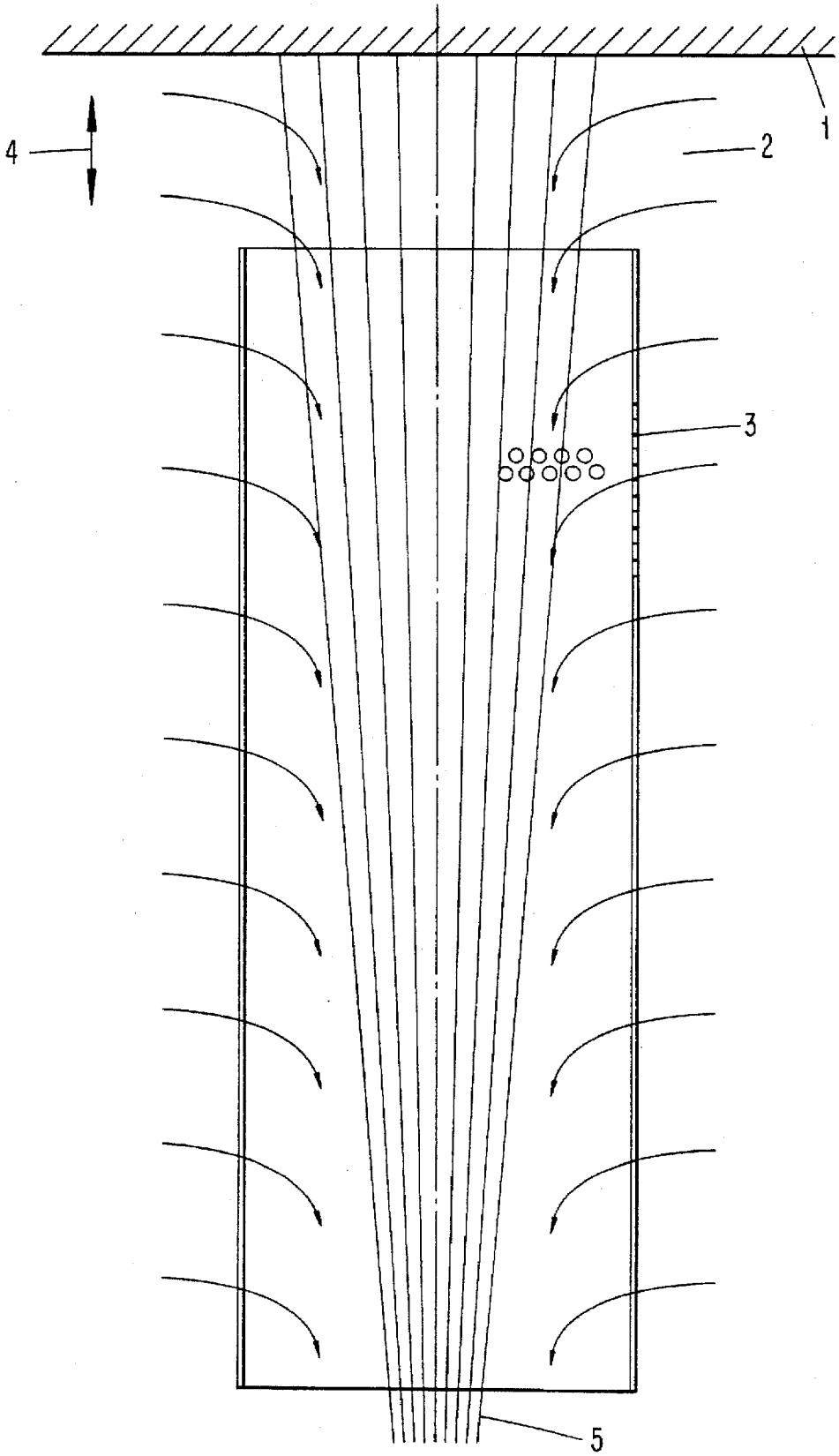
FIGS. 1–6 schematically show various embodiments of the device according to the invention, more specific shows FIG. 1 a cooling channel with perforated walls, adjustable with a space towards the lower side of the spinning head, FIG. 2 a cooling channel adjustable in its distance towards the lower end of the spinning head with double walled cylinder arrangement, with fixed spaces concentrically arranged against each other, and perforated walls, FIG. 3 a cooling channel connected directly to the lower side of the spinning head with adjustable inlet cross section of the perforation in the area near the spinning head, FIG. 3A a fragmentary view of adjusted openings in the cooling channel shown in FIG. 3, FIG. 4 a cooling channel with adjustable space to the lower side of the spinning head and with perforation of adjustable inlet cross section over the whole length of the channel FIG. 4A a fragmentary view of adjusted openings in the cooling channel shown in FIG. 4, FIG. 5 the conically shaded lower part of a cooling channel FIG. 6 a cooling channel, as shown in FIG. 1, however, with rectangular cross section.

FIG. 1 shows schematically, as an example, a cooling channel arranged with a space (2) to the lower side of the spinning head (1), said channel concentrically enclosing the filaments (5) coming out of the spinning head and which mainly consists of a metal cylinder (3). Adjustment (4) of the space (2) allows one to arrange the perforated metal cylinder (3), towards the spinning head, at a smaller or greater distance.

The space (2) should at a maximum be only so big that an air current develops within the direction of the filaments. In case of a larger opening, rising warm air would leave, and near the thread there would be the danger of arising turbulences of the differently directed air currents. Additionally, the space (2) minimizes heat transfer from the spinning head to the cooling device.

The perforated metal cylinder (3) is provided with openings, over its entire wall, which are evenly distributed thereon, and whereby the air inlet is selectable within a wide range. However, the air resistance should not rise as high in order not to influence the suction effect. Too large openings should also be avoided, in order to depress air movements within the surrounding area. It has proved to be suitable to have a number of free intake cross sections (holes) of maximum 50% of the total surface. Instead of the shown perforated metal cylinder also a metal screen cylinder can be applied.

Since each thread bundle is separately enclosed by the air permeable wall (3) of the cooling channel, the cooling air (arrows) taken in, through the suction effect of the filaments, is directed mainly radially from the outside to the inside. The air is taken from the environment and therefore has a temperature which corresponds to the one in the spinning mill.

Below the cooling channel is a thread oiling device not shown or another thread guide to bundle the cooled filaments into a thread which is then guided towards a drawing-off device.

Figure 2:
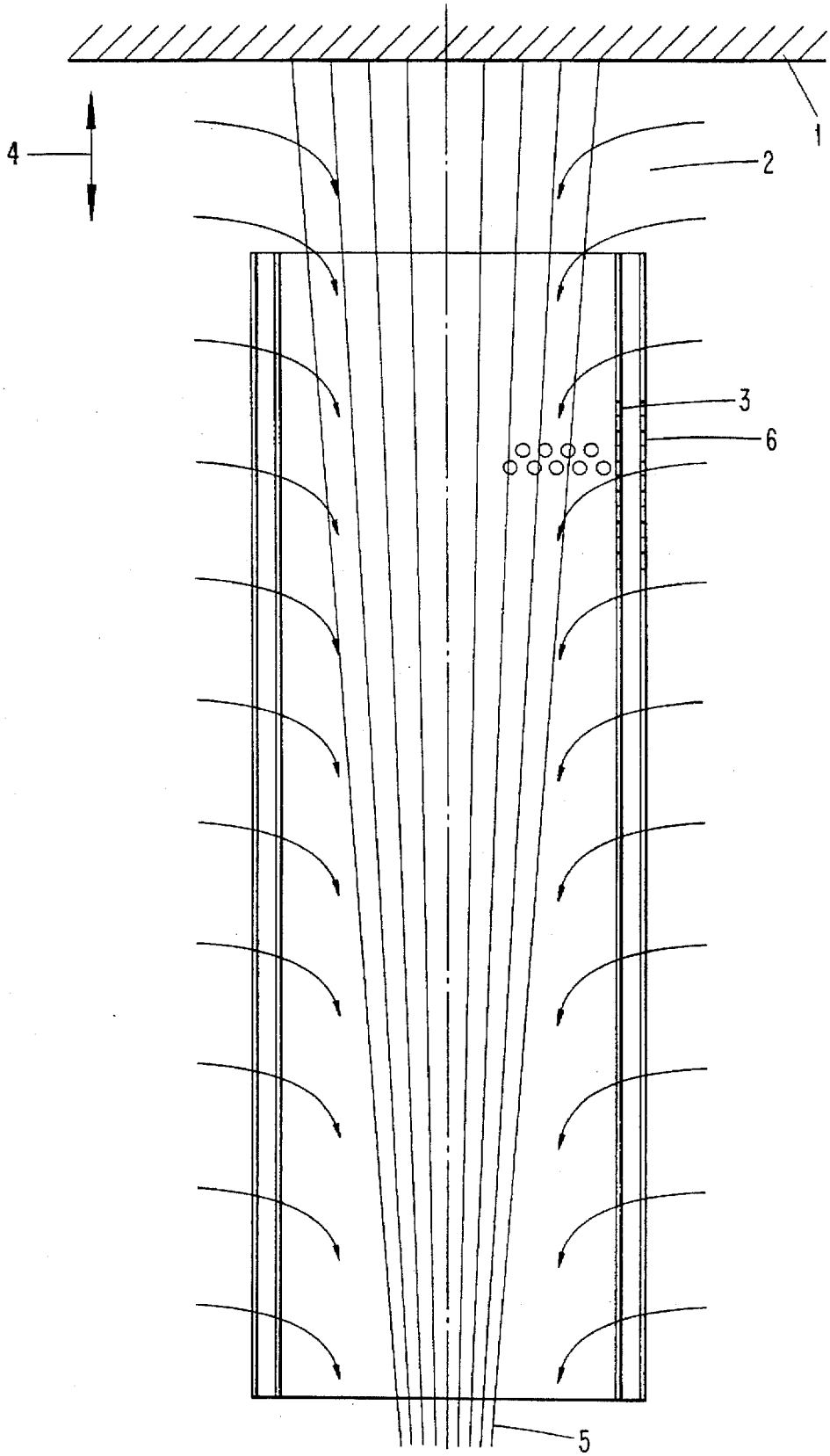

The cooling channel shown schematically in FIG. 2 is similar to the one in FIG. 1. A second perforated metal cylinder (6) arranged concentrically at a fixed distance to the first (3) allows to additionally buffer eventual air movements in the spinning mill, for instance opening and closing of doors. A wall distance of the two perforated metal cylinders of a maximum of 20 mm is recommended.

Figure 3:
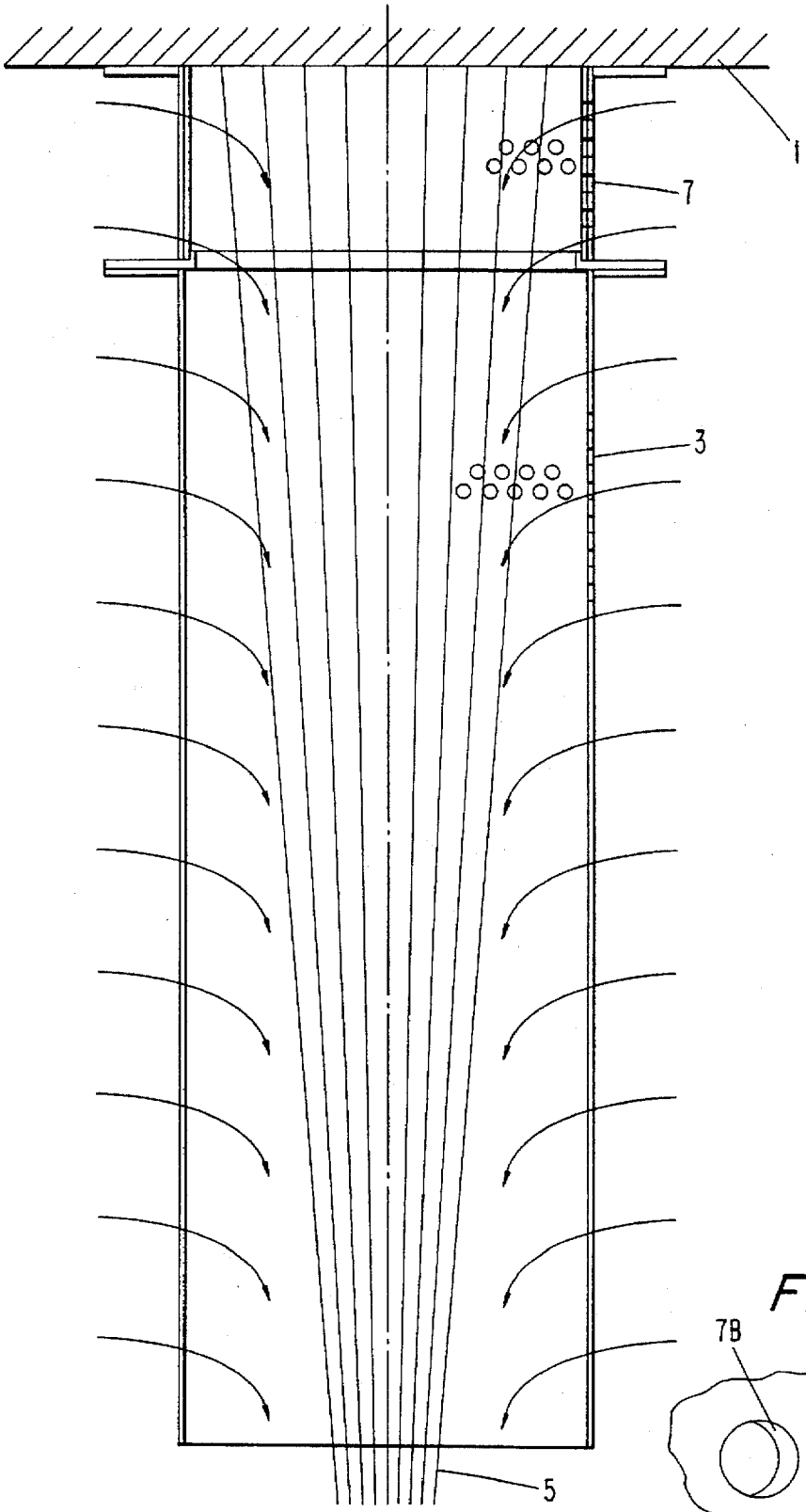
Figure 3A:
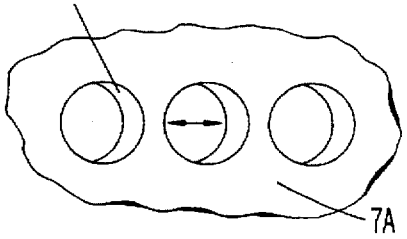

Another embodiment of the device according to the invention is shown in FIG. 3. The air permeable wall begins immediately below the spinning head (1). The perforated metal cylinder 7A forming the cooling channel is, in the area near the spinning head, enclosed by a second perforated metal cylinder (7) said second cylinder directly contacting the first. Both perforated metal cylinders show the same perforation so that through a rotational movement of the second perforated metal cylinder (7) the opening size of the holes 7B of the first cylinder can be adjusted to be either completely open or more or less covered. Regulation of the air inlet in this area near the spinning head is thus possible. The perforated metal cylinder (3) being attached in downward direction is similar to the one in FIG. 1, however without adjustment of a space towards the spinning head.

Figure 4:
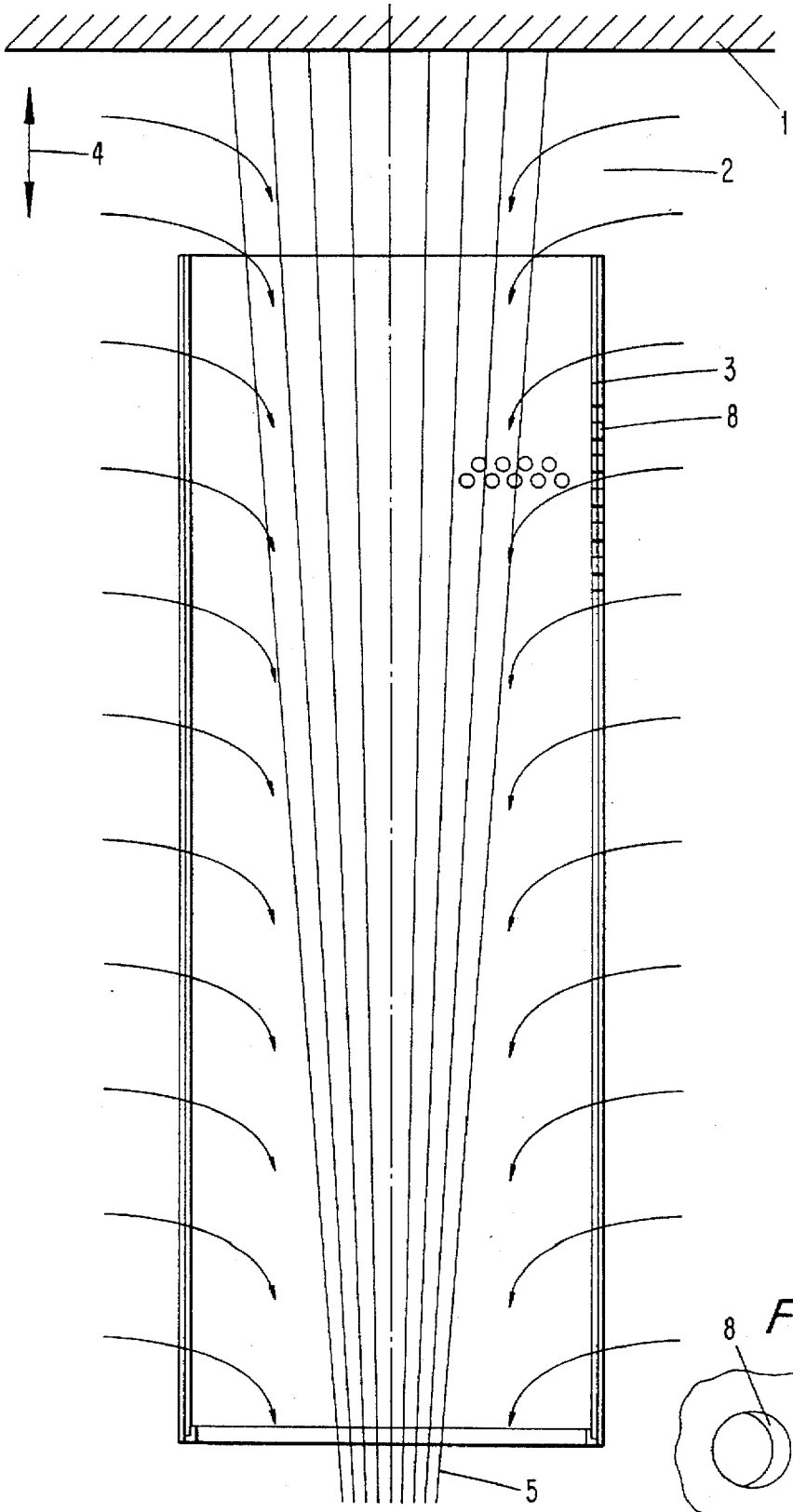
Figure 4A:
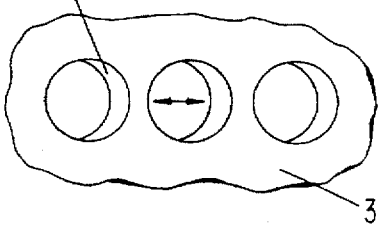

A further embodiment is shown in FIG. 4. This cooling channel is basically similarly designed like the one shown in FIG. 1, a space (2) to the lower side of the spinning head (1) and a channel (3) with perforated wall, arranged to be adjustable (4) in its height. A second perforated channel of the same shape (8) connecting with the first perforated channel (3), allows regulation of the air inlet over the total height of the channel.

Adjustment is done through turning or shifting of the two perforated channels (3 and 8) towards each other. An optimal setting of the air inlet in the area near the spinning head as well as over the total height of the channel is thus possible.

Figure 5:
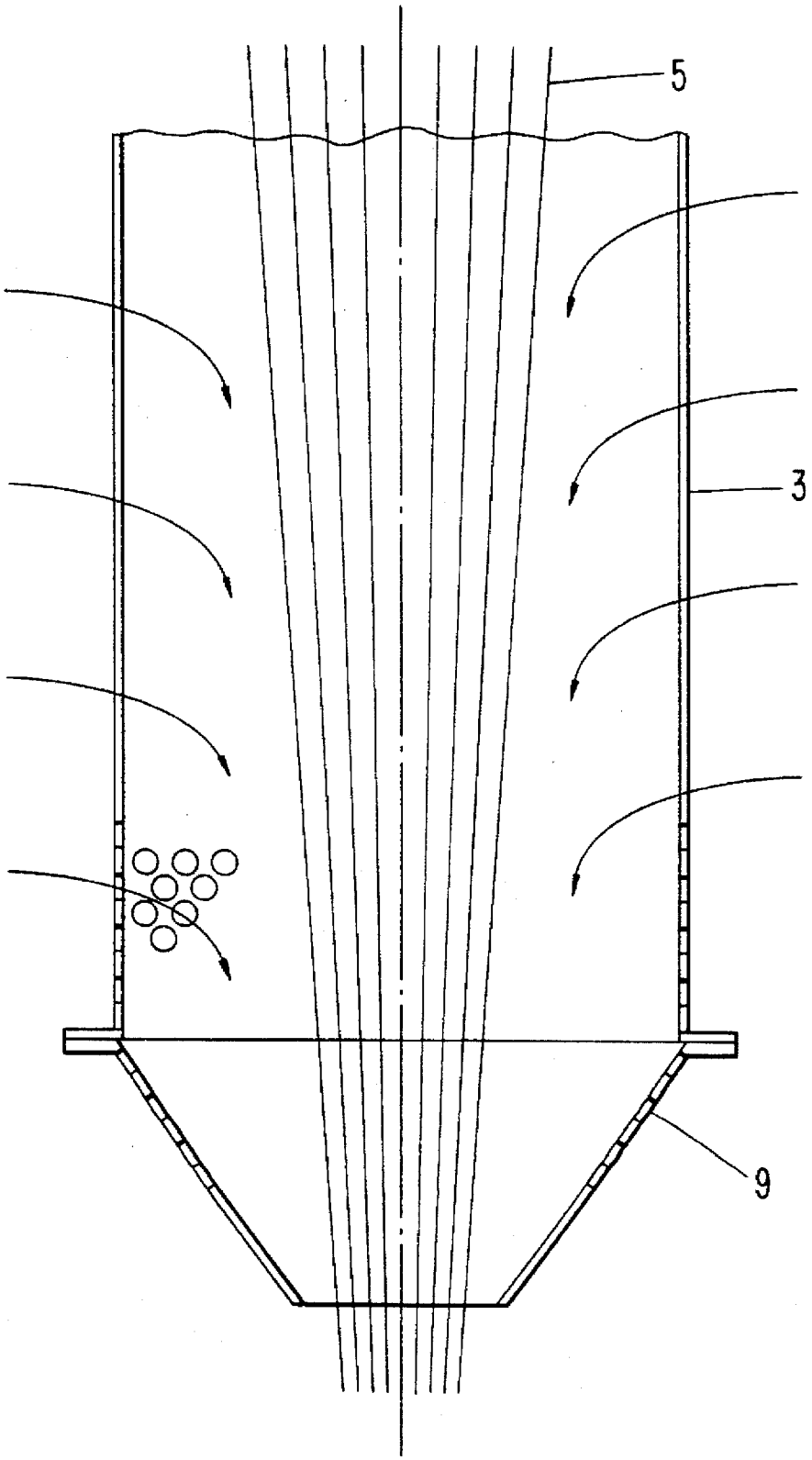

Alternatively to FIGS. 1, 2 and 4 showing schematically drawing-off channels with constant cross section, FIG. 5 shows a cooling channel according to the invention whose perforated outlet zone (9), is conical with converging cross section towards the lower end. This improves the injection effect.

Figure 6:
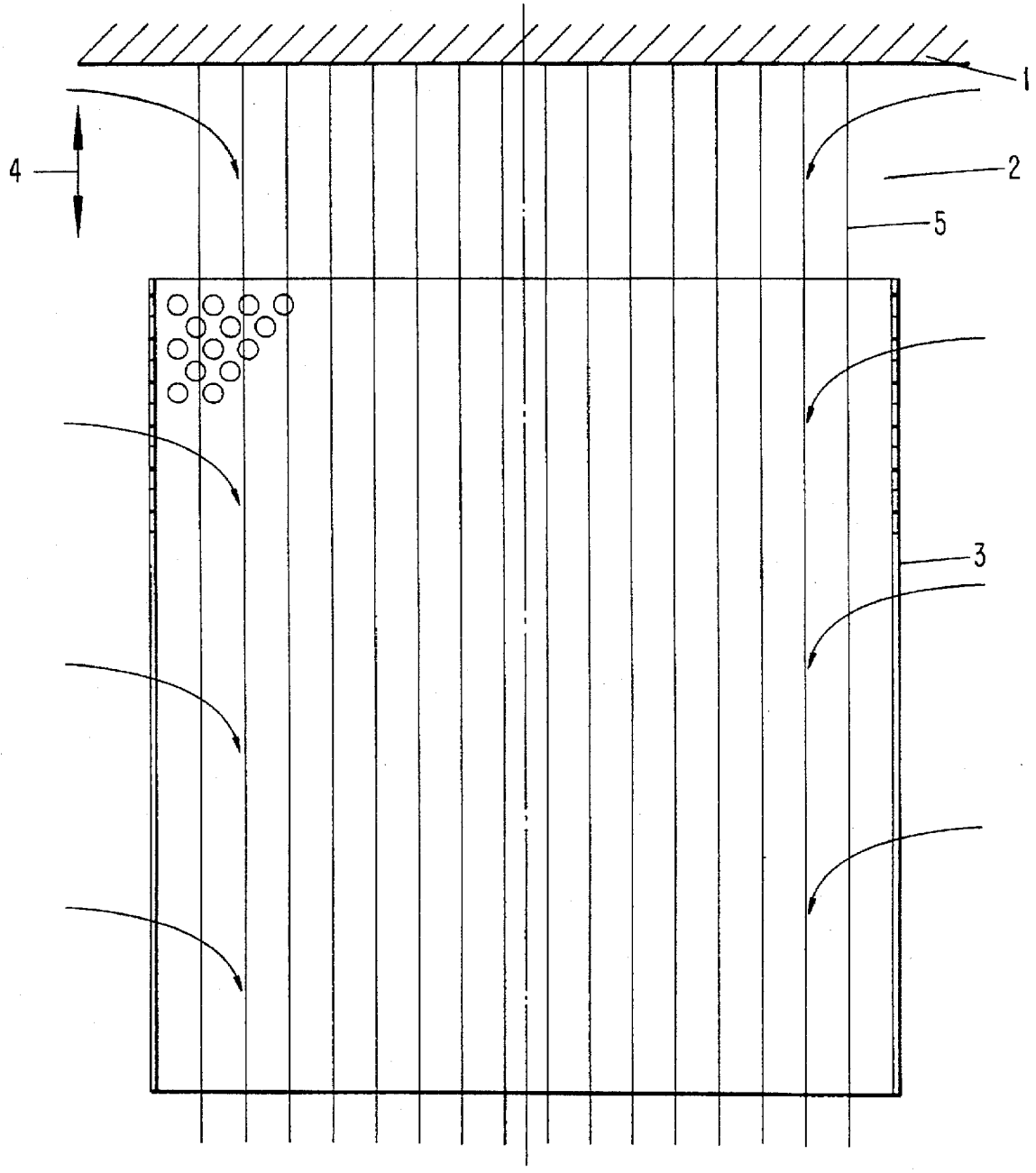
Figure 6A:
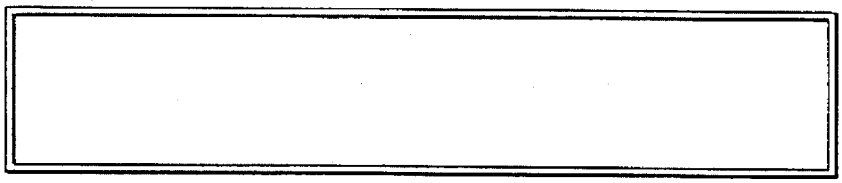
FIG. 6A an end view of the channel shown in FIG. 6.

FIG. 6 is an example for a cooling channel with a rectangular cross section, which is used for spinning heads with rectangular nozzle plates. Otherwise the channel corresponds with the design of the device according to FIG. 1.

Figure 7:
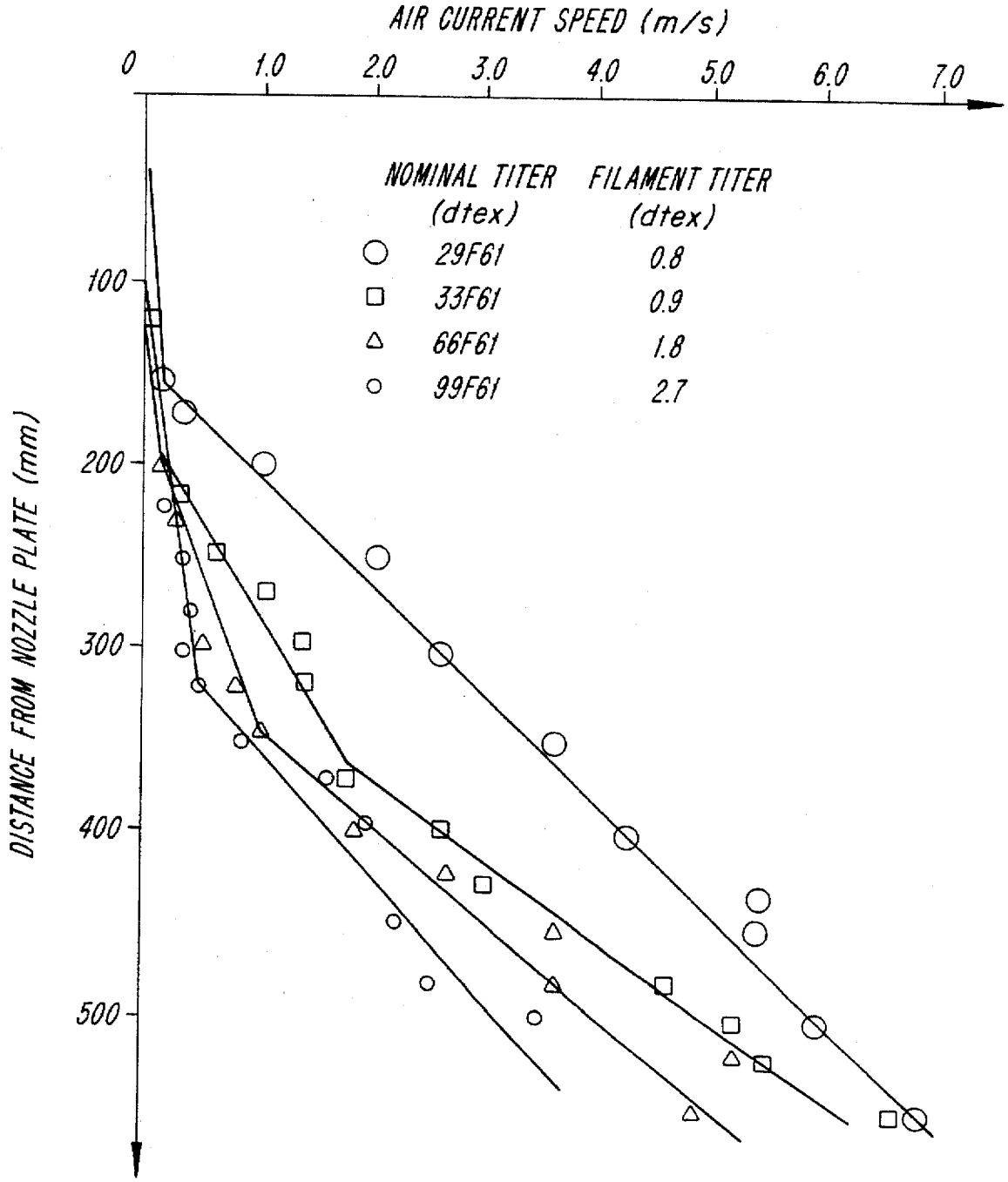
FIG. 7 shows the speed of the air carried by the filament bundle in function of the distance from the spinning nozzle (spinneret) in a spinning device without forced inlet of air.

FIG. 7 shows measurements of the speed of the air carried by the filament bundle at various spaces from the nozzle plate in relation to the filament titer. Measurement were always taken during spinning of polyethylenterephthalat (PET) of an intrinsic viscosity (I.V.) of 0.67 dl/g with the help of a spinning device without forced inlet of the air (this means without conventional blowing channel and without cooling device according to the invention) at a winding speed of 3200 m/min. The vertical component of the air current was measured by using an ALNOR anemometer, measuring range 0.1–30 m/sec. The speed of the air is a measurement for the air moved by the suction effect of the filament bundle. The lower speed of the air together with the same space measurement to the nozzles at higher titer characterizes its slower cooling. The figure shows that by increasing the distance of the bundeling point from the nozzle plate the quantity of cooling air can be increased to any desired amount, whereby sticking together of the filaments can be prevented.

However, the distance of the convergence thread guide from the nozzle plate and thus from the cooling channel should not be too big. The air which is carried along increases the friction between the filaments and the air and thus the thread tension of the filament bundle. With fine filaments and high drawing-off speeds these could reach the ultimate point of the tensile strength of the filaments and could cause filament breaks.

EXAMPLE 1

PET flakes with a viscosity of I. V.=0.67 dl/g are melted and, at a temperature of 300° C., the melt is pressed through the holes of the nozzle plate in a spinning head (spinneret) of conventional design. The nozzle plate's diameter is 70 mm; the diameter of the areas with the holes is 55 mm; the 61 holes are of a diameter d=0.25 mm and a caplillar length of L=2 D.

The capacity was 17.3 g/min, the nominal titer dtex 33f61, whereby the spinning titer per filament amounted to 0.89 dtex.

After that the threads entered a cooling channel consisting of a screen cylinder of the length L=350 mm, diameter=100 mm, mesh 600/cm2. The space between the lower edge of the spinning head and the upper edge of the cylinder varied between 0 and 15 mm, so that a corresponding free space was provided. The ambient air temperature around the screen cylinder is 23° C.

At a distance of 530 mm from the lower edge of the spinning head a thread oiler was mounted to apply a watery emulsion, whereby the dosage of one application on the filament bundle corresponded with 0.8%. The oiler is the first point of convergence of the filament bundle. After that the thread was wound by means of a winding unit, furnished with a device to reduce tension, at a winding speed of 3200 m/min.

The best Uster-half inert values of 0.80% were obtained with a space of 0–5 mm. At a 15 mm space the U-value was 7.2%.

EXAMPLE 2

The procedure was as in example 1, however had in addition a screen cone at the outlet of the screen cylinder, whereby the opening for the thread outlet was of diameter= 30 mm. The Uster value was improved to U=0.60%.

EXAMPLE 3

PET flakes with a viscosity of I. V.=0.67 dl/g are melted and, at a temperature of 294° C., the melt is pressed through the holes of a nozzle plate. The nozzle plate's diameter is 80 mm; the diameter of the area with holes was 70 mm, the diameter of the holes=0.17 mm, L=2 D.

In a first trial the number of holes in a nozzle plate was 72, in a second trial it was 144. The capacity was, accordingly 16.0 g/min i.e. 31.0 g/min, so that a nominal titer of 36f72 i.e. 72f144 corresponding with a comparable spinning titer per filament of 0.8 dtex resulted.

Directly adjacent to the spinning head was a perforated cylinder of length L=500 mm, diameter=100 mm, diameter of holes=5 mm, evenly spread over the walls. The free cross section was 34% (39×70 holes).

The cylinder is surrounded by air at room temperature of 28° C. The point of convergence is formed by the thread oiler, which was at a distance of 250 mm to the cooling cylinder. The average distance of the single filaments at the cylinder outlet lays, depending of the number of capillars, between 1.7 and 2.5 mm. After that the filament bundle was drawn off by means of galettes and wound with a winding device at 2800 m/min. The degree of spinning orientation, characterized through the value of elongation at break, and the further characteristic data and their evenness are shown in table 1.

TABLE 1

| Blowing on - perforated tube | | | |
|---|---|---|---|
| nominal titer | dtex | 36f72 | 72f144 |
| spinning fineness | dtex | 56.4 | 109.4 |
| breaking strain | cN | 156.9 | 301.8 |
| breaking strain - CV | % | 2.5 | 2.1 |
| tensile strength | cN/tex | 27.8 | 27.6 |
| elongation at break | % | 126.8 | 125.5 |
| elongation at break - CV | % | 3.8 | 3.1 |
| Uster, half inert | % | 0.26 | 0.66 |

EXAMPLE 4

The procedure was as in example 3, however by varying the distance of the thread oiler to the perforated cylinder between 50 and 850 mm corresponding with a distance to the spinning head from 550 to 1350 mm. Testing was done at the nominal titer 36f72 dtex. At 850 mm distance increasingly spinning breaks occurred, caused by the relatively high thread tension because of a too long open distance of the filament bundle. At distances below 850 mm the Uster value remained unchanged at good 0.39–0.58%.

EXAMPLE 5

PET flakes of a viscosity I. V.=0.63 dl/g were melted and, at a temperature of 294° C., the melt was pressed through the holes of a nozzle plate. The nozzle plate had a diameter of 80 mm; the diameter of the area with holes was 70 mm, the diameter of the holes=0.25 mm, L=2 D. The number of holes in the nozzle plate was 34.

The capacity was 18.5 g/min so that a nominal titer of dtex 50f34 corresponding to a spinning titer per filament of 1.47 dtex resulted.

The cylinder was positioned at a space of 50 mm to the spinning head as described in example 3.

The cylinder is surrounded by air at room temperature of 29° C. The point of convergence is formed by a thread oiler, which had a distance to the cooling cylinder of 600 mm. The average space of the single filaments at the cylinder outlet was approximately 5.9 mm.

After that the filament bundle was drawn off and wound at a speed of 3700 m/min by a winding device, said winding device was furnished with a grooved roller which was driven with a lead of 6% to compensate the tension. The degree of spinning orientation is characterized by the elongation at break of the wound filament bundle of 95%, the tensile strength was 28.8 cN/tex.

The Uster evenness was excellent and was Uster half inert=0.39%.

EXAMPLE 6

The procedure was as in example 5, however with the measure that the drawing off speed of 4200 to 5700 m/min, at a lead of the grooved roller, up to 10% was varied. Furthermore, the capacity was increased in a way and to each speed adjusted separately, that the spinning titer dtex 76f34 was kept constantly corresponding to a single filament titer of 2.24 dtex.

The characteristics of the threads and the evenness values are listed in table 2.

TABLE 2

| Speed (m/min) | 4200 | 4700 | 5200 | 5700 |
|---|---|---|---|---|
| Capacity (G/min) | 31.9 | 35.7 | 39.5 | 42.9 |
| Titre (dtex) | 76.1 | 76.2 | 76.1 | 76.9 |
| Break strain (cN) | 232.5 | 243.8 | 249.1 | 258.9 |
| CV-break strain (%) | 2.3 | 1.8 | 1.8 | 1.7 |
| Tensile strength (cN/tex) | 30.6 | 32.0 | 33.0 | 33.7 |
| Elongation at break (%) | 85.5 | 72.5 | 60.4 | 54.3 |
| CV-elongation at break | 2.9 | 3.7 | 5.1 | 3.9 |
| Uster-half inert (%) | 0.35 | 0.62 | 0.32 | 0.41 |

The preceding examples show that when applying the embodiments according to the invention, i.e. the method and the device, filament characteristics are obtained which at least correspond with the ones reached with conventional systems and in certain highly sensitive forms of application, such as the manufacturing of microfilaments at drawing off speeds of more than 2400 m/min, these can be improved and this with extremely inexpensive devices.

We claim:

1. A method for spinning and cooling synthetic, multifil, endless filaments, comprising the steps of:

spinning filaments from apertures of a nozzle plate at a draw-off speed of at least 2400 m/min., and passing the filaments through a cooling channel disposed beneath the apertures so that the filament travel draws an air current inwardly through air inlet means of the cooling channel and into cooling relationship with the filaments throughout the length of the cooling channel, a portion of air current being drawn in at an upper end of the cooling channel and contacting the filaments immediately as the filaments emerge from the apertures, and additional portions of the air current being drawn in throughout the length of the cooling channel.

2. Method according to claim 1 including causing the filaments to exit the cooling channel with an average spacing between the filaments being greater than zero but less than 6 mm.

3. Method according to claim 1 including adjusting the size of the air inlet means to vary the amount of air entering the cooling channel.

4. Apparatus for spinning and cooling synthetic, multi-fil, endless filaments, comprising the steps of:

a spinning nozzle having apertures from which filaments are drawn, and a cooling channel disposed beneath the apertures and through which the filaments are passed, the cooling channel including air inlet means for enabling the filament travel to draw a current of cooling air into the cooling channel and into cooling relationship with the filaments throughout the length of the cooling channel, said inlet disposed at an upper end of the cooling channel such that the filaments are contacted by the cooling air immediately upon emerging from the nozzle, and additional inlets disposed throughout the length of the cooling channel.

5. Apparatus according to claim 4, wherein the cooling channel is perforated throughout its length.

6. Apparatus according to claim 5, wherein the upper end of the cooling channel is spaced from the nozzle to form therewith a gap defining the upper air inlet.

7. Apparatus according to claim 6, wherein the gap is sized to permit the entry of only air.

8. Apparatus according to claim 4 including means for adjusting the size of the upper air inlet.

9. Apparatus according to claim 8, wherein the upper inlet is defined by apertures in a cooling channel section, means provided for adjusting the size of the apertures.

10. Apparatus according to claim 9, wherein the cooling channel section of the upper inlet comprises coaxial, telescoping cylindrical walls through which the apertures extend, one wall being rotatable relative to the other for adjusting the size of the apertures.

11. Apparatus according to claim 4, wherein the cooling channel includes additional air inlet apertures along its length, and means for adjusting the size of the additional apertures.

12. Apparatus according to claim 11, wherein the cooling channel comprises coaxial, telescoping cylindrical walls through which the additional apertures extend, one wall being rotatable relative to the other wall for adjusting the size of the additional apertures.

13. Apparatus according to claim 11, wherein the cooling channel comprises two coaxial, telescoping cylinders spaced radially apart by about 20 mm, both cylinders being perforated to provide the additional air inlets.

14. Apparatus according to claim 4, wherein a lower portion of the cooling channel is conically shaped so as to be of reduced cross section in a downward direction toward an exit of the cooling channel, the exit being sized to permit passage of a filament bundle of at least 10 mm in cross-sectional area.

* * * * *